United States Patent [19]

Koppe

[11] Patent Number: 4,509,313

[45] Date of Patent: Apr. 9, 1985

[54] POUCH FORMING AND FILLING APPARATUS

[76] Inventor: Robert G. Koppe, 4243 Dickman Rd., Apt. 3C, Battle Creek, Mich. 49015

[21] Appl. No.: 386,815

[22] Filed: Jun. 9, 1982

Related U.S. Application Data

[62] Division of Ser. No. 106,124, Dec. 21, 1979, Pat. No. 4,353,198.

[51] Int. Cl.[3] ..... B65B 43/34; B65B 43/30

[52] U.S. Cl. ..... 53/570

[58] Field of Search ..... 53/570, 562, 571, 266, 53/267, 268, 373, 371, 386, 511; 141/270, 255, 260, 264, 317

[56] References Cited

U.S. PATENT DOCUMENTS

| | | | |
|---|---|---|---|
| Re. 26,553 | 3/1969 | Nutting et al. | 53/562 |
| 2,722,358 | 11/1955 | Wilson | 53/571 X |
| 2,923,111 | 2/1960 | Selock | 53/386 X |
| 3,323,280 | 6/1967 | Rausch | 53/571 |
| 3,344,576 | 10/1967 | Cloud et al. | 53/562 X |
| 3,381,446 | 5/1968 | Marchand | 53/562 |
| 3,568,402 | 3/1971 | Lense et al. | 53/570 X |
| 3,700,388 | 10/1972 | Johnson et al. | 53/562 |
| 4,033,093 | 7/1977 | Mencacci | 53/571 X |
| 4,035,988 | 7/1977 | Daniels | 53/386 X |
| 4,081,942 | 4/1978 | Johnson | 53/511 X |

*Primary Examiner*—Horace M. Culver

*Attorney, Agent, or Firm*—Flynn, Thiel, Boutell & Tanis

[57] ABSTRACT

Individual separated pouches are supplied to the inlet station of an endless continuously-moving carrier provided with adjustable pouch-supporting mechanisms at uniform intervals therealong. Each mechanism supports the pouch adjacent the opposite upper corners thereof. The pouch is moved past an opening station which fully opens the pouch mouth. The pouches are continuously moved through a filling station having plural material-guiding funnels which are rotatably supported and move at the same speed as the pouches when positioned thereover. A control mechanism, synchronized with the pouch carrier, lowers opposed spring-urged fingers into the pouch mouth to center same under the funnel and securely hold same open. Thereafter the guide funnel is lowered into the open mouth and material is deposited through the funnel into the pouch. The funnel and fingers are then raised out of the pouch. The pouch and its supporting mechanism then passes into a tensioning station which stretches the pouch mouth and also effects heating thereof. The filled pouch then passes through a sealing station which heat seals the pouch mouth, whereupon the support mechanism releases the pouch.

4 Claims, 15 Drawing Figures

POUCH FORMING AND FILLING APPARATUS

This application is a division of application Ser. No. 106,124, filed Dec. 21, 1979, now U.S. Pat. No. 4,353,198.

FIELD OF THE INVENTION

This invention relates to an improved apparatus for the automated handling and filling of pouches, particularly pouches which have a bottom gusset and/or are nonself-supporting, in an efficient and dependable manner.

BACKGROUND OF THE INVENTION

Bags or pouches are utilized for packaging numerous materials and products, being extensively used for packaging both dry and liquid food products. The pouch-type package is widely used for dry or powderlike materials, such as cake mixes and the like. The bag or pouch is conventionally formed from a sheetlike material, such as either a heat-sealable plastic or a laminate having at least a heat sealable coating.

It is conventional to form, fill and seal such pouches on either of two basic types of machines, one being referred to as a "continuous" machine, and the other being referred to as an "intermittent" machine. Neither of these types of machines, however, have provided the maximum rate of utilization required for optimum efficiency of production coupled with maximum flexiblity and adaptability for forming and handling different sizes and shapes of pouches, particularly pouches which have a bottom gusset and/or are nonself-supporting.

For example, in one typical "continuous" machine, the sheet stock used for forming the pouch is continuously withdrawn from a roll and a plurality of pouches are formed in adjacent and interconnected side-by-side relationship. The series of interconnected pouches is fed to the filling station, such as a rotatable table or turret whereupon the individual pouches are filled, and from which the pouches are then fed to a sealing station so as to close and seal the pouches. The pouches, still joined together in series, are then fed to a cutting station which separates the pouches from one another. While this "continuous" machine is desirable from the standpoint of being operable at a relatively high production rate, nevertheless this machine is extremely complex both structurally and operationally, and is undesirably costly. Further, this machine is normally suitable for handling only a single size pouch since the pouches must necessarily be handled when still series-connected together inasmuch as the actual separation of the individual pouches occurs only after the pouches have been filled and sealed. Such a machine can not be readily adjusted for handling different size pouches, and hence such machine is traditionally utilized only in those situations requiring extremely large volumes of identical pouches such that the machine can be utilized continuously over long periods of time for forming and filling identical pouches.

In another type of "continuous" machine, the pouches are preformed and individually separated prior to filling and sealing thereof. However, with this machine, the pouches are supported by a structure which supportingly engages the bottom of the pouch, so that the pouch thus stands upright in a self-supporting manner during the filling and sealing operation. This type of machine is thus limited for use with pouches which are relatively stiff, such as pouches which are of heavy paper or foil laminate, since such pouches are basically self-supporting and will remain in an open upright position even when supported solely at the bottom. This machine, however, is incapable of handling pouches formed of thin extremely flexible material, such as conventional thin plastic, since such pouches are not self-supporting and hence are incapable of being supported solely at the bottom. Further, this known "continuous" machine is also unsuitable for use with pouches employing a bottom gusset, namely those pouches requiring filling with a substantial quantity of material, since the bottom support of the pouch restricts and effectively prevents opening of the bottom gusset. This machine is thus severely limited in that it is primarily usable only with nonbottom-gusseted pouches constructed of stiff material so that the pouches are substantially self-supporting.

Accordingly, when handling pouches which employ a bottom gusset, and/or are constructed of an extremely flexible material such that the pouch is not self-supporting when supported from the bottom, the industry has accordingly utilized an "intermittent" type machine which provides a suspension system for supporting the pouch during the filling and sealing operations. The "intermittent" machine has also been extensively utilized in those situations where adjustability and optimum flexibility are required, that is, in those situations where the machine must be easily capable of accommodating and adjusting to different sizes and types of pouches.

With the "intermittent" machine, the partially-formed pouches are individually separated prior to filling, whereupon the machine then possesses various pouch-holding devices which themselves are designed to accommodate different sizes of pouches. The individually separated and preformed pouches are then filled on this type of machine, and thereafter sealed. To permit the handling of the individual preformed pouches, however, the machine normally moves in an intermittent steplike manner, which thereby greatly restricts the filling rate of the machine, such that these machines thus fill and seal a substantially smaller number of pouches per hour than is possible with a "continuous" machine.

To permit the "intermittent" machine to accommodate pouches of different size, one known machine utilizes a pouch-supporting device which supports the pouch adjacent only one side thereof. This arrangement provides obvious disadvantages since it provides nonuniform support of the pouch and hence makes filling difficult. This also complicates the sealing of the top edge of the pouch after the filling step has been completed.

Other "intermittent" machines have attempted to overcome the problems associated with those machines which support the pouch at only a single side by utilizing a device which supports the opposite upper corners of the pouch. These machines, however, have not been adjustable and have necessarily relied upon devices which are complex both structurally and operationally.

Another problem commonly encountered on known machines is the difficulty in eliminating the wrinkles from the open top of the filled pouch prior to sealing thereof. This difficulty has resulted in improper sealing of some pouches, and hence results in a certain percentage of pouches being unacceptable for commercial use.

Accordingly, this invention relates to an apparatus for the continuous handling, filling and sealing of pouches, particularly pouches having a bottom gusset and/or not being capable of self-support.

More specifically, this invention relates to an improved apparatus which permits the continuous handling, filling and sealing of individual bottom-gusseted and/or nonself-supporting pouches at a very rapid and efficient rate, with the improved apparatus of this invention additionally having a pouch supporting mechanism which can be readily adjusted to accommodate pouches of different size and shape while still permitting such pouches to be handled continuously and automatically at a very rapid rate.

According to this invention, pouches are formed in a conventional manner from a folded web of heat sealable material, such as a plastics material, which pouches are open at the upper edge and are initially joined together in series. The pouches are then separated from one another, and the individual separated pouches are automatically supplied to the inlet station of an endless continuously-moving pouch carrier which is provided with adjustable pouch-supporting mechanisms at uniform intervals therealong. Each pouch-supporting mechanism suspendingly supports the pouch adjacent the opposite sides thereof in the vicinity of the upper edge, and the pouch is moved past an opening station which, by utilizing suction cups and air jets, results in the pouch being fully opened. The pouches are then continuously moved into and through a filling station, which filling station incorporates a plurality of material-guiding funnels which are rotatably supported in a turretlike arrangement and move at the same speed as the pouches when positioned over the open mouths thereof. A control mechanism, which is synchronized with the movement of the pouch carrier, lowers a guide finger arrangement such that a pair of opposed spring-urged fingers enter into the mouth of the pouch to both center same under the funnel and securely hold same open, and shortly thereafter the lower end of the guide funnel is lowered into the open mouth of the pouch to insure that the material is properly deposited therein. After a proper metered amount of material has been deposited through the funnel into the pouch, the guide funnel and the fingers are raised upwardly out of the pouch, and the pouch then passes through a vibrating station which removes excess material and causes settling of the material within the pouch. The pouch and its associated supporting mechanism then passes into a tensioning station which stretches the mouth of the pouch so as to effectively close same and remove any wrinkles therefrom, and at the same time effects heating of the pouch mouth. The filled pouch then passes through a conventional sealing station which effectively heat seals the pouch mouth, whereupon the support mechanism thereafter releases the pouch for discharge to an external conveyor or like device. The empty pouch-support mechanism then continues along its endless path and again reaches the inlet station whereupon a new but empty preformed pouch is again fed to and supported on the mechanism.

Other objects and purposes of the invention will be apparent to persons familiar with apparatus of this general type upon reading the following specification and inspecting the accompanying drawings.

DETAILED DESCRIPTION

Figure 1:
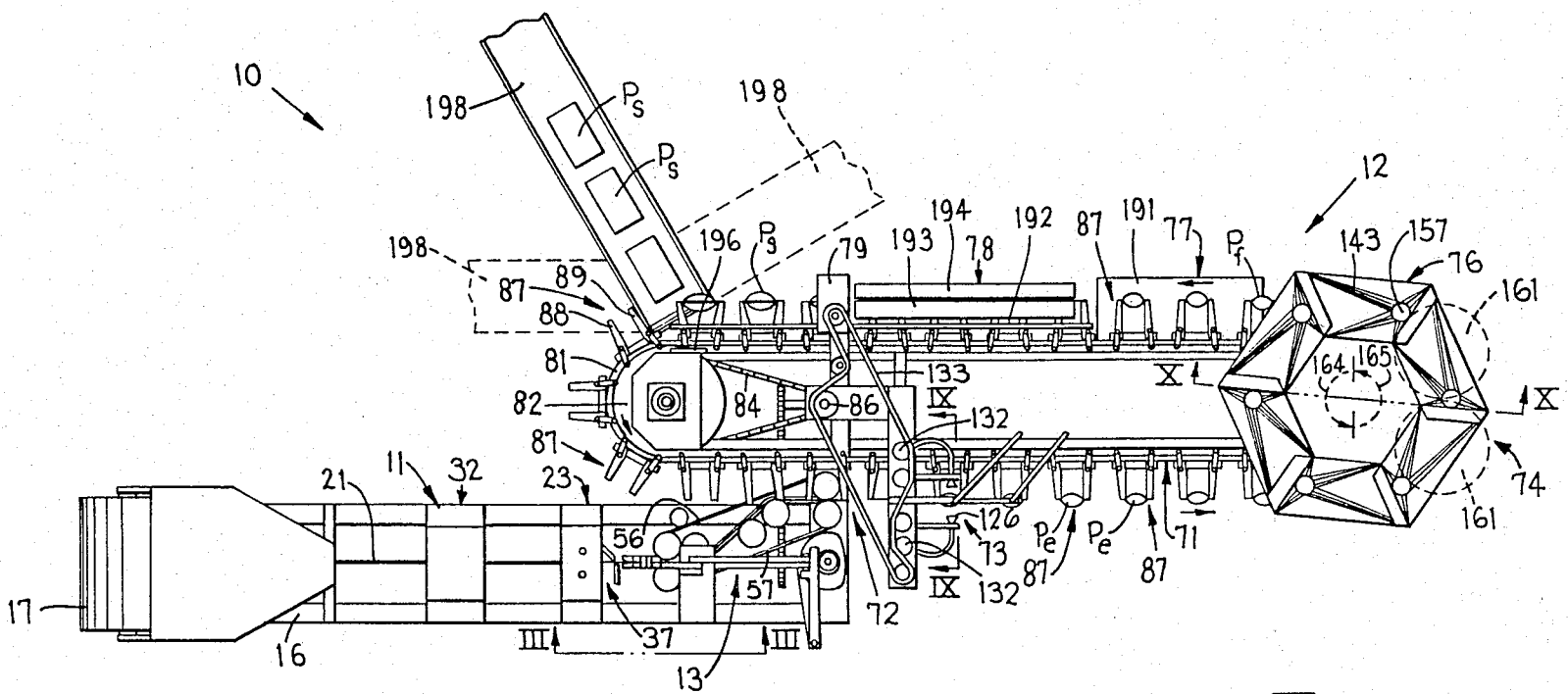
FIG. 1 is a plan view of an apparatus according to the present invention.
Figure 2:
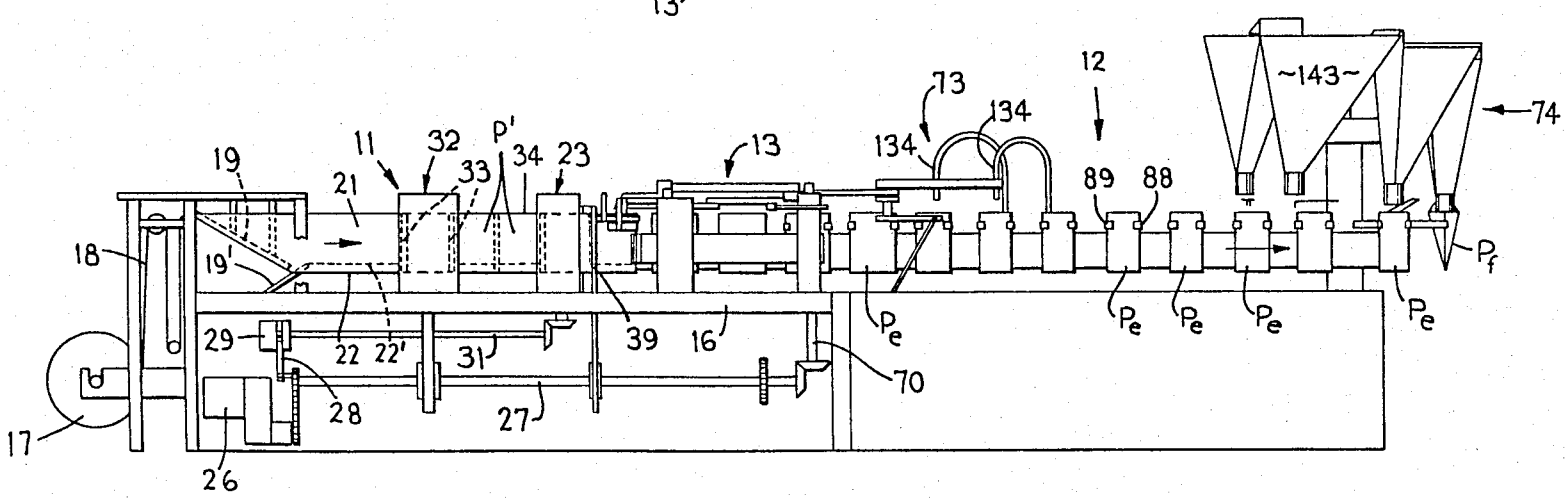
FIG. 2 is a front view of the apparatus shown in FIG. 1, and illustrating specifically the structure for the partial forming of pouches.

FIGS. 1 and 2 illustrate therein a pouch-forming and filling system according to the present invention. This system includes an intermittent pouch-forming apparatus 11 which permits the repetitive forming of individual pouches from a continuous sheet or roll of plastic material, a continuous pouch-filling and sealing apparatus 12 which automatically fills and seals the preformed empty pouches, and a transfer apparatus 13 which effectively transfers the preformed empty pouches from the intermittent forming apparatus 11 to the continuously-moving apparatus 12.

Pouch-Forming Apparatus

The pouch-forming apparatus 11 includes a stationary frame 16 which supports thereon a conventional roll 17 of thin nonstiff sheetlike material, such as a plastics material or a laminate having a heat-sealable coating thereon. The material, in the form of a sheet or film 18, is withdrawn from roll 17 and passes over a conventional guide or plow 19 which results in the film being folded over onto itself, as illustrated at 21, the bottom edge 22 of the folded film 21 defining the fold line. As is conventional, the lower tip 19' of the plow is directed upwardly to form a conventional folded gusset 22' at the bottom of the film.

The folded film 21 is linearly advanced in an intermittent steplike manner (rightwardly in FIG. 2) by a film advancing mechanism 23 which is substantially conventional and includes a pair of counterrotating drive rolls 24 (FIG. 4) having the folded film 21 drivingly engaged therebetween. These rolls 24 are driven unidirectionally in an intermittent manner from a conventional motor 26, the latter causing continuous rotation of a first drive shaft 27 having a rotatable crank 28 associated therewith, which crank is connected to a connecting link which in turn drives a conventional oneway clutch 29, the latter driving a second drive shaft 31 unidirectionally in an intermittent manner so as to thus cause similar rotation of the drive rolls 24.

A sealing device 32 is positioned for cooperation with the folded film 21 at a location spaced upstream from the advancing mechanism 23. This sealing device 32 is of substantially conventional construction and includes a pair of opposed sealing plates which are located on opposite sides of the folded film 21, and are intermittently moved toward and away from the film in a repetitive and intermittent manner, due to their being driven through a crank and lever arrangement from the shaft 27. When the sealing plates are moved toward one another so as to clampingly engage the stationary folded film 21 therebetween, the seal plates result in the simultaneous formation of two vertical seal strips 33 which extend the full height of the film 21, these sealing strips being formed by a pair of electrically heated sealing elements as associated with each sealing plate.

After passing through the sealing device 32, the folded film 21 thus defines a plurality of preformed pouches P′ which are still connected together in series. The upper edge 34 of the individual pouches is unsealed, thus defining an openable mouth, whereas the bottom of the pouch is formed by the folded gusset 22′.

The series-connected preformed pouches P′, after passing through the drive mechanism 23, are then intermittently advanced in a steplike manner to a cutoff device 37 to effectively sever the pouches P′ from one another. This cutoff device 37 (FIGS. 3 and 4) includes a vertically elongated blade 38 which is fixedly positioned adjacent one side of the film, and a vertically elongated blade 39 which is movably positioned adjacent the other side of the film, this latter blade 39 being intermittently moved toward and away from the blade 38, as by being driven through a crank and linkage mechanism connected between the blade 39 and the drive shaft 27. This back-and-forth movement of blade 39, which is synchronized with the intermittent advancing movement of film 21, results in the blade 39 effecting severing of each pouch P′ along the seal strip 33.

The pouch, after being severed from the film by the blade 39, must be handled individually since it is no longer joined to any other pouches. This individual preformed empty pouch, after separation from the other pouches, is designated $P_e$ for convenience in reference.

The intermittent pouch-forming apparatus 11, as briefly described above, is substantially conventional and hence further detailed description thereof is believed unnecessary.

Pouch-Transfer Apparatus

The pouch-transfer apparatus 13 is comprised of two portions, namely an intermittent transfer mechanism 41 for engaging and advancing the individual preformed pouches $P_e$ after their separation, and a continuous transfer mechanism 42 which receives the individual pouches $P_e$ from the mechanism 41 and moves them into position for engagement with and support by the continuous pouch handling apparatus 13.

Figure 3:
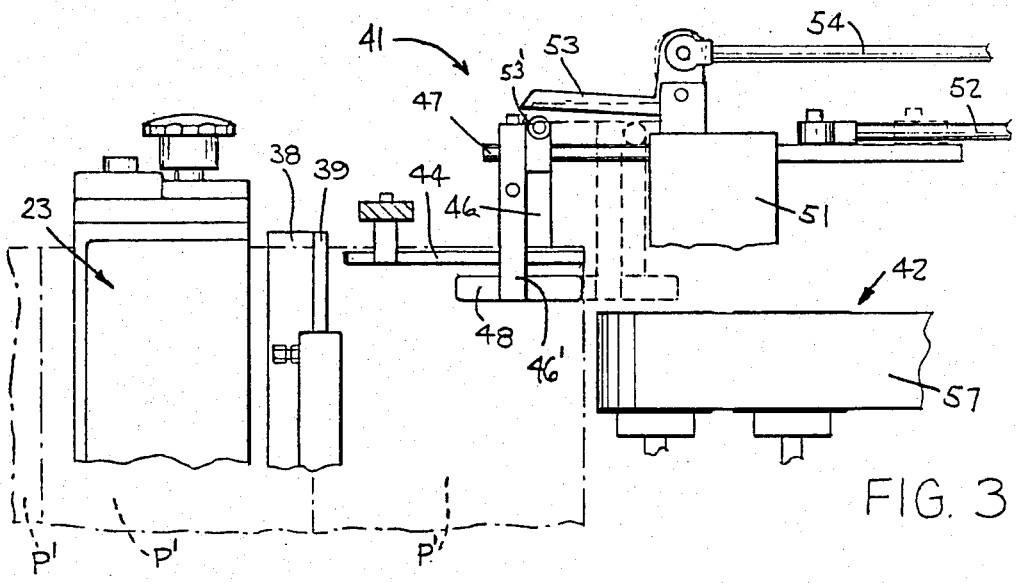
FIG. 3 is an enlarged fragmentary front view taken substantially along the line III—III in FIG. 1, and illustrating the pouch transfer mechanism.
Figure 4:
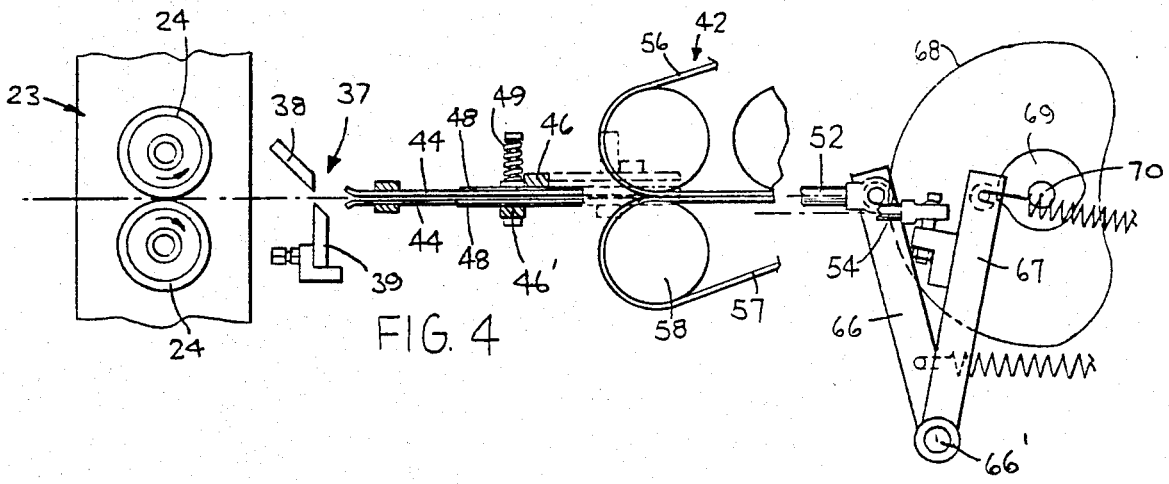
FIG. 4 is a top view of the apparatus shown in FIG. 3.

The intermittent transfer apparatus 41, as illustrated by FIGS. 3 and 4, is positioned in alignment with the folded film 21 having the preformed empty bags P′ serially connected together, the transfer apparatus 41 being disposed closely adjacent but downstream of the cutoff device 37. This transfer apparatus 41 includes a pair of stationary guide bars 44 which are fixedly mounted relative to the frame and extend from a position closely adjacent the cutoff blade, downstream therefrom, so that these guide bars 44 define a narrow slot therebetween so as to receive the upper edge portion of the leading series-connected pouch P′. After the cutter blade 39 has been activated to sever and thus separate the leading pouch P′ from the remaining film strip, it is engaged by the apparatus 41 and advanced forwardly, as explained hereinafter.

For the above purpose, the apparatus 41 includes a pair of opposed elongated clamping pads 48 which are mounted on the lower ends of a pair of arms 46 and 46′, these latter arms at their upper ends being supported on a rod 47. The arm 46′ is fixedly supported on this rod, whereas arm 46 is pivotally supported on the rod and, due to the urging of a spring 49, arm 46 is urged toward the arm 46′ so that the pads 48 are thus normally urged toward one another so that the upper portion of the pouch P′ can be gripped therebetween.

The rod 47 is fixedly secured to a slide 51 which is appropriately supported on the frame so as to be linearly displaceable back and forth in a direction parallel to the folded film. This slide 51 is connected to one end of a connecting rod 52, the other end of which is connected to a lever 66 which is pivoted at 66′. The lever is spring urged such that a cam follower mounted on the lever continually bears against a rotatable cam 68. Rotation of cam 68 causes the slide 51 to be reciprocated back and forth so that the clamping pads 48 are reciprocated between the solid and dotted line positions shown in FIGS. 3 and 4.

The slide 51 has an L-shaped actuator cam or lever 53 pivotally supported thereon, which cam 53 is adapted for engaging a cam follower 53′ associated with the arm 46 so as to cam same outwardly in opposition to the spring 49, thereby effecting separation of the clamping pads 48. This cam 53 is pivotally actuated by a further connecting rod 54, the latter being pivotally connected to a further lever 67 which also pivots at 66′. The lever 67, which is also spring urged, has a cam follower thereon which is continuously maintained in engagement with a further rotary cam 69. Cams 68 and 69 are both secured to a rotatable shaft 70 which is continuously rotatably driven from the shaft 27 through an intermediate bevel gear arrangement.

The cam 53 is pivoted upwardly so as to allow the spring 49 to close the clamping pads 48 when the pads are in their rearwardmost position, as shown by solid lines in FIGS. 3 and 4, whereby the pads thus engage the leading series-connected pouch P′ prior to its separation from the series by the blade 39. Substantially simultaneous with the engagement of the pads 48 with the pouch P′, blade 39 is activated so as to separate this pouch (now designated $P_e$) advanced so as to be engaged by the continuous transfer mechanism 42, as described hereinafter. When reaching this forwardmost position, cam 69 activates the cam lever 53 downwardly so that the clamping pads 48 are released from the pouch, and the other cam 68 returns the slide 51 rearwardly so as to engage the next preformed pouch.

The continuous transfer mechanism 42 (FIG. 5) includes a pair of endless flat belts 56 and 57 supported on a plurality of rotatable pulleys 58, the pulley 58' as associated with each belt being continuously rotatably driven from the shaft 27 through suitable intermediate gearing (not shown) so that the belts 56 and 57 move at the same speed. These belts 56 and 57 are positioned so as to have substantial portions thereof disposed in opposed adjacent relationship so as to grippingly engage and support a preformed pouch $P_e$ therebetween.

The continuous transfer mechanism 42 includes an inlet 61 which is defined by opposed portions of belts 56–57, and is substantially aligned with the folded film 21. This inlet portion 61 is followed by an intermediate portion 62 which is also defined between opposed portions of the flat belts, which intermediate portion 62 extends at an angle relative to the inlet 61 and is directed inwardly toward the pouch-filling and sealing apparatus 12. The intermediate portion 62 in turn terminates in an outlet or discharge portion 63, the latter being defined by opposed adjacent portions of the belts which extend parallel to the inlet portion 61 but are displaced sidewardly therefrom so as to be located more closely adjacent the apparatus 12.

The pouch $P_e$ is fed into the inlet portion 61 by the intermittent transfer mechanism 41, thereby causing the pouch to be engaged by and supported between the belts 56 and 57, which belts move continuously at a constant speed. The belts thus carry the pouch $P_e$ from the inlet portion 61 through the intermediate portion 62 and then discharge same as the discharge portion 63, at which time the pouch $P_e$ has been picked up by the pouch-filling and sealing apparatus 12, as explained hereinafter.

Continuous Pouch-Filling and Sealing Apparatus

The pouch-filling and sealing apparatus 12, as illustrated in FIG. 1, includes an endless pouch carrier 71 having associated therewith an inlet station 72 at which the empty pouches $P_e$ are supplied to and gripped by the pouch carrier. Slightly downstream of the inlet station 72 there is provided an opening means 73 which insures that the upper edge or mouth of the pouch $P_e$ is fully opened, following which the pouches are then supplied to a filling station 74 as located adjacent one end of the endless carrier 71. This filling station 74 includes a rotatable turretlike filling apparatus 76 which is supported above the endless carrier 71. After the pouches on the carrier 71 are filled at the station 74, the carrier then moves the filled pouches through a vibrator 77 to effect settling of the material within the pouches, with the pouches then being carried through a heating device 78 for heating, the upper edges of the pouch, followed by passage through a sealing device 79 for sealingly closing the mouth of the pouch. The sealed pouches are then discharged from the endless carrier, such as by being deposited on a conveyor 198 or other suitable removal device.

Considering first the endless pouch carrier 71, same includes an endless flexible drive element formed as a chain 81 disposed in a substantially horizontal loop. This chain 81 is drivingly engaged with and supported on a pair of horizontally spaced sprockets 82 (FIG. 1) and 83 (FIG. 10), which sprockets are disposed at opposite ends of the carrier 71 and hence result in the chain having the opposite side reaches thereof being elongated and stretching in substantially straight and parallel directions. The sprocket 82 is used for driving the chain 81, and for this purpose the sprocket 82 is driven from an intermediate drive chain 84 which itself is driven from a shaft 86, which latter shaft is continuously rotatably driven from the main drive shaft 27 through an intermediate drive mechanism utilizing conventional gears, chains and the like.

The endless pouch carrier 71 has a plurality of pouch support mechanisms 87 associated therewith, which mechanisms 87 are connected to the chain 81 at uniformly spaced intervals therealong.

As illustrated by FIGS. 5–8, the pouch support mechanism 87 includes leading and trailing arms 88 and 89, respectively, which are substantially identical except for being mirror images of one another. Thus, only the trailing arm 89 will be described in detail.

The arm 89 includes a horizontally elongated lever 91 swingably supported by a vertical pivot shaft 92, the latter being mounted on and projecting upwardly from a support block 93. A torsion spring 94 coacts between block 93 and pivot shaft 92 for continuously resiliently urging the arm 89 inwardly (counterclockwise in FIG. 6) towards its closed or pouch-supporting position, in which position the arm 89 bears against a stop 96 which is fixed to and projects upwardly from the block 93.

The arm 89 also includes a pouch clamping member 97 which is linearly slidably supported on the lever 91, this being accomplished by screws 98 which are fixed to the lever 91 and are guidably associated with elongated slots 99 formed in the clamping member 97. This latter member extends longitudinally along one side of the lever 91 and, at its forward or outer end, has an inwardly bent portion 101 which overlaps the front face 102 of the lever 91 and functions as a pouch-clamping jaw. The jaw 101 is adapted to be moved into substantial engagement with the front face 102 when a pouch is to be clamped therebetween. The inner face of jaw 101 and the lever face 102 can be provided with suitable serrations or other clamping projections thereon if desired.

The rearward or inner end of the pouch clamping member 97 terminates in a rear tab 103 which is bent inwardly so as to be disposed in confronting relationship with the rearward end of lever 91. A suitable compression spring 104 is seated within a recess or pocket formed in the inner end of the lever 91, and the spring 104 in turn bears against the rear tab 103 so as to continuously resiliently urge the jaw clamping member 97 into its closed position as illustrated by solid lines in FIG. 6.

The inner end of member 97 also has a top tab 106 associated therewith, which tab supports thereon a roller-type cam follower 107, the latter being supported for rotation about a substantially vertical axis. The roller 107 as associated with each trailing arm 89 is positioned above the tab 106, whereas the coresponding roller 107' as associated with each leading arm 88 is located below the respective tab 106. Each of the arms 88 and 89 also has a further cam roller 108 associated therewith, this latter roller being rotatably mounted directly on the lever 91 and positioned adjacent the upper surface thereof. The cam roller 108 is positioned with its rotational axis in close proximity to but spaced sidewardly from the pivot axis defined by the pivot shaft 92 for a purpose to be explained hereinafter.

Figures 5, 6, 7:
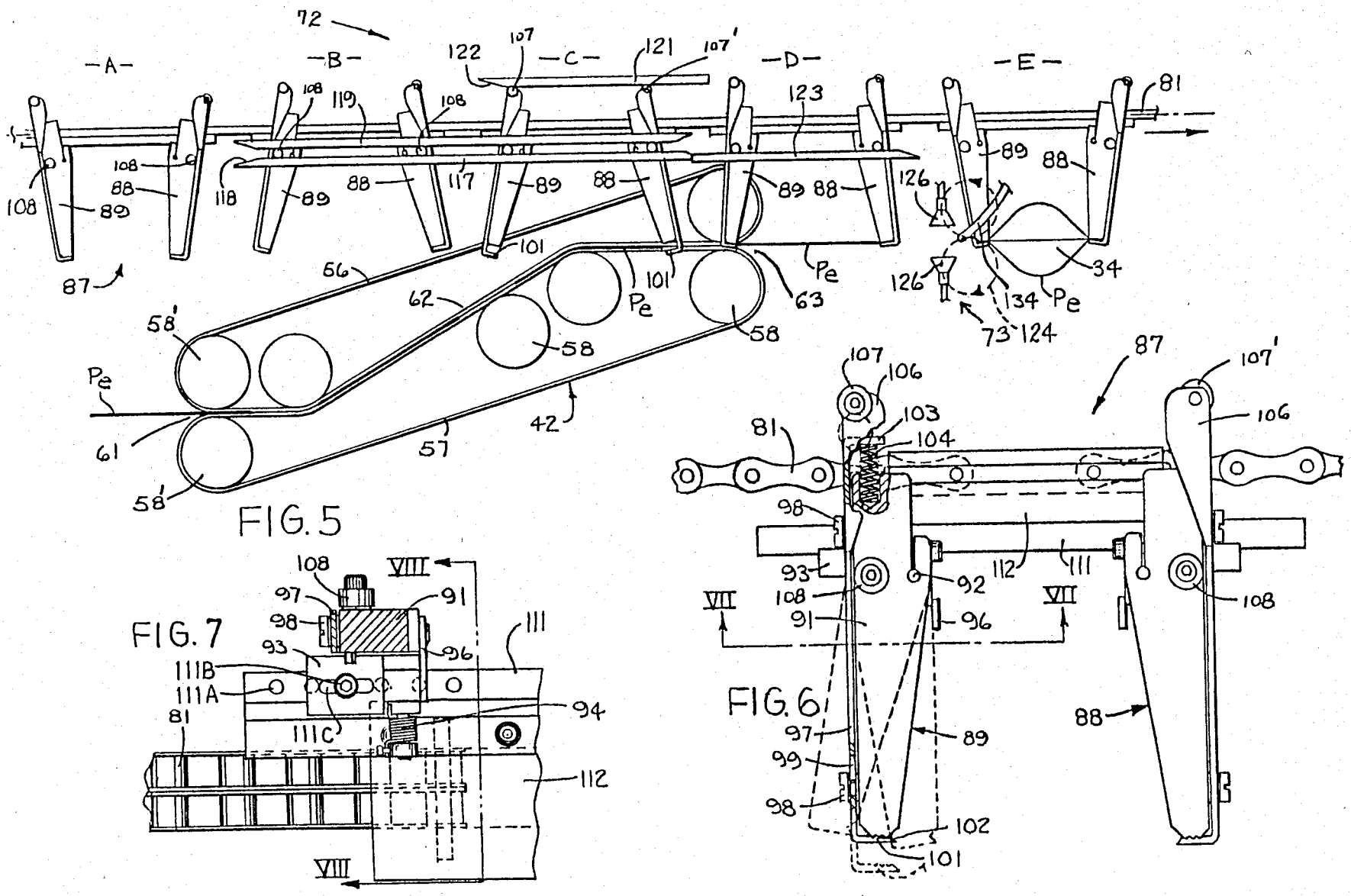
FIG. 5 is an enlarged fragmentary top view illustrating a portion of the endless pouch carrier and of the pouch feeding device.
FIG. 6 is an enlarged fragmentary top view illustrating one of the pouch-support mechanisms as associated with the endless carrier.
FIG. 7 is a fragmentary view, partially in cross section, taken along line VII—VII in FIG. 6.

Each pouch support mechanism 87 has an elongated mounting block 111 associated therewith, which in turn is secured by bolts or screws to a chain block 112, the latter being an integral part of and functioning as one of the links of the endless chain 81. The mounting block 111 has the support block 93 connected thereto and, for this purpose, the front face of mounting block 111 has a plurality of threaded openings 111A associated therewith as indicated in FIG. 7, whereby the screw 111B used for securing the support block 93 to the mounting block 111 passes through the slot 111C and engages one of the openings 111A. This permits the support block to be infinitely adjustably positioned so as to permit the spacing between the cooperating pair of arms 88–89 to be selectively adjusted to accommodate pouches of different widths.

Figure 8:
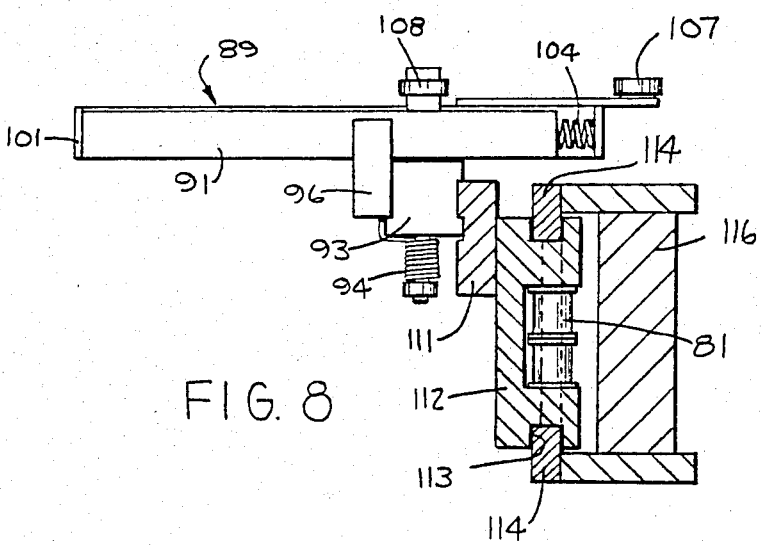
FIG. 8 is a fragmentary view, partially in cross section, taken along line VIII—VIII in FIG. 7.

The chain block 112, as illustrated in FIG. 8, has elongated guide grooves 113 formed in the upper and lower surfaces thereof, which guide grooves slidably accommodate therein stationary elongated guide rails 114 which are fixedly associated with the machine frame 116. These guide rails 114 extend along the straight reaches of the endless chain 81 so as to provide for slidable support of the chain, thereby preventing the chain and the pouch support mechanisms 87 mounted thereon from being moved inwardly or outwardly, or twisted within a vertical plane.

To activate the pouch support mechanisms 87 at the inlet station 72, the apparatus 12 is provided with actuating structure in the form of cams for causing appropriate actuation of the individual mechanisms 87. As illustrated in FIG. 5, there is provided a first elongated cam 117 which is stationarily fixed relative to the frame and extends parallel with the chain 81 throughout a major portion of the inlet station 72. This elongated cam 117 has an inlet ramp 118 formed at the upstream end thereof, with the remainder of the cam 117 functioning solely as an elongated straight guide rail. When the chain 81 movably carries the pouch support mechanism 87 from the position "A" illustrated in FIG. 5 into the beginning of the inlet station, as indicated by position "B", the roller 108 on leading arm 88 contacts the ramp 118 and causes the arm 88 to be swung (counterclockwise) into its open position, and thereafter the roller 108 on trailing arm 89 also contacts ramp 118 and is likewise swung (clockwise) into its open position. The arms are then maintained in this open position, as indicated by position "B", due to the cam rollers 108 bearing against the inner straight cam surface defined by the remaining portion of the cam rail 117. A further guide rail 119 extends parallel with and is disposed inwardly from the cam rail 117 solely so as to accurately confine the cam rollers 108 therebetween. Thereafter the cam rollers 107 and 107' contact the leading edge or ramp 122 of a further elongated straight cam rail 121 as associated with the inlet station 72, thereby causing the pouch clamping members 97 to be slidably moved outwardly to thereby open the jaws 101, as indicated by position "C". With the pouch support mechanism 87 in its wholly opened condition illustrated by position "C", and when this mechanism is moved slightly downstream from position "C", the continuous pouch transfer mechanism 42 causes one of the preformed pouches $P_e$ to be moved into the discharge section 63 thereof such that the upper portion of the pouch is thus disposed between and aligned with the open jaws 101 due to the synchronized movement of the endless pouch carrier 81 and the pouch transfer apparatus 42.

The chain 81 then carries the pouch support mechanism 87 downstream into the next position illustrated as "D" in FIG. 5, in which position there is provided a further elongated stationary cam rail 123, the latter being a substantial continuation of the rail 117 but having its inner cam surface spaced slightly outwardly from the inner surface of rail 117. Thus, when the cam roller 108 of the leading arm 88 moves into engagement with cam rail 123, the spring 94 causes pivoting of the arm 88 so that it partially swings (clockwise in FIG. 5) towards its innermost or pouch supporting position, which partial swinging of arm 88 results in the leading edge of the pouch $P_e$ being positioned between the open jaw 101 and the opposed clamping face 102. Shortly after cam roller 108 of arm 88 engages the cam rail 123 as described above, the cam roller 107' then drops off the cam rail 121, whereby spring 104 thus retracts the clamping member 97 so that the leading edge (in the vicinity of the upper corner) of the pouch $P_e$ is thus clamped between the jaw 101 and the face 102.

The trailing arm 89 cooperates with the cams 121 and 123 in the same manner as described above relative to the leading arm 88, so that the trailing arm thus clamps the trailing upper corner of the pouch $P_e$ shortly after the leading upper corner has been clamped, whereby the pouch $P_e$ is then securely suspended from and clampingly held by the arms 88 and 89 as indicated by position "D", the arms 88–89 still being in an intermediate position so that the suspended pouch is effectively maintained in a taut condition between the arms. The pouch, by this time, has now exited from the discharge 63 of the transfer apparatus 42.

As the support mechanism 87, and the pouch $P_e$ suspended therefrom, passes beyond the inlet station 72, it moves substantially immediately past the opening means 73, and at this time the cam rail 123 terminates so that the cam rollers 108 thus move out of engagement with this cam rail and hence the springs 94 thus cause the arms 88 and 89 to be individually swingably moved into their innermost positions wherein the spacing between the opposed pair of jaws is less than the width of the pouch $P_e$. This movement, coupled with the action of the opening means 73, insures positive opening of the pouch mouth 34, such as indicated by position "E" in FIG. 5.

Figure 9:
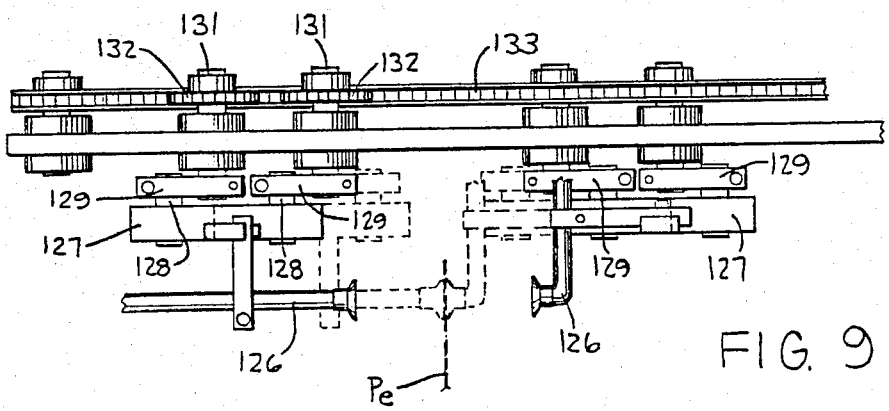
FIG. 9 is an enlarged, fragmentary view taken substantially along line IX—IX in FIG. 1.

The opening means 73, as indicated in FIGS. 5 and 9, includes a pair of opposed suction cups 126 which are positioned on opposite sides of the pouch $P_e$, these suction cups being individually connected to a suitable source of suction or partial vacuum. These suction cups 126 are individually mounted on carrier blocks 127, each of which is supported on a pair of downwardly projecting crank pins 128 which extend in parallel relationship, which crank pins are associated with a pair of rotatable cranks 129. Each crank in turn is secured to a rotatable shaft 131, and a sprocket 132 is secured to each shaft 131 and is disposed in engagement with an endless drive chain 133 which is driven from shaft 86 as indicated in FIG. 1. The two sprockets 132 associated with the suction cup 126 shown on the left side of FIG. 9 rotate in one direction, whereas the two sprockets associated with the rightmost suction cup 126 in FIG. 9 rotate in the opposite direction. The two suction cups thus move in a circular or orbital manner, as indicated by the dotted paths 124 shown in FIG. 9, so that the movement of the suction cups is thus synchronized with the movement of the mechanisms 87 whereby the cups 126 thus come into light contact with the opposite sides of the pouch $P_e$ shortly after the mechanism 87 moves out of engagement with the cam strip 123. The suction cups thus assist in opening the mouth of the pouch simultaneous with the inward closing swinging movement of the arms 88 and 89, thereby insuring that the pouch $P_e$ is supported with its mouth 34 fully open as indicated by position "E" in FIG. 5.

To further assist in fully opening the pouch, the opening means 73 also includes a pair of nozzles 134 which are located directly above the path of movement of the pouches, and are spaced downstream of one another, for directing an air stream downwardly into the at least partially opened pouch to insure that each pouch $P_e$ is fully opened when suspended on the mechanism 87.

After moving past the opening means 73, the empty but opened pouches $P_e$ as suspended by the mechanisms 87 are then sequentially and continuously moved into and through the filling station 74 to permit the pouches to be filled with the requisite amount of desired material or product. The filling station 74, and specifically the rotatable filling assembly 76, will now be described in detail, particularly with reference to FIGS. 10–14.

The filling assembly 76 includes rotatable support plates 141 and 141' (FIG. 10) fixedly secured to the upper end of a vertical drive shaft 142, the latter being connected to and driven by the sprocket 83. The support plates 141–141' have mounted thereon, by means of parallelogram linkages, a plurality of guide funnels 143 which are disposed in an annular array in surrounding relationship to the plate 141. Each guide funnel 143 is hingedly connected in vertically spaced relation to the radially outer ends of parallel support arms 144–144' which project radially outwardly of the plates 141–141' and have the inner ends thereof hingedly supported on plates 141–141' by hinge assemblies 146–146', the latter permitting the arms to pivot vertically through a limited angular extent. The parallel relationship of arms 144–144' maintains the respective funnel 143 in a vertical orientation while permitting limited vertical displacement thereof. The inner end of arm 144 has a bracket associated therewith which carries a pair of cam rollers 147 and 151. The cam roller 147, due to the weight of the funnel 143, is continuously urged into rolling engagement with the periphery of a disc cam 148 which is stationarily secured relative to the frame 116. The other cam roller 151 is adapted to move into engagement with the periphery of a further disc cam 149, the latter being rotatably supported relative to the shaft 142 and, in fact, being rotatably driven in the opposite rotational direction at a relatively high rate of rotation, this being accomplished by any conventional intermediate gear mechanism (not shown) or the like drivingly connected between shaft 142 and cam 149. This cam 149 has a plurality of small uniformly spaced lobes formed thereon due to the cam periphery being formed by a plurality of flats, and thus effectively imposes a high speed vibration on the arm 144 and its associated funnel 143 when the latter is in the lowered position illustrated by the right side of FIG. 10.

Figure 11:
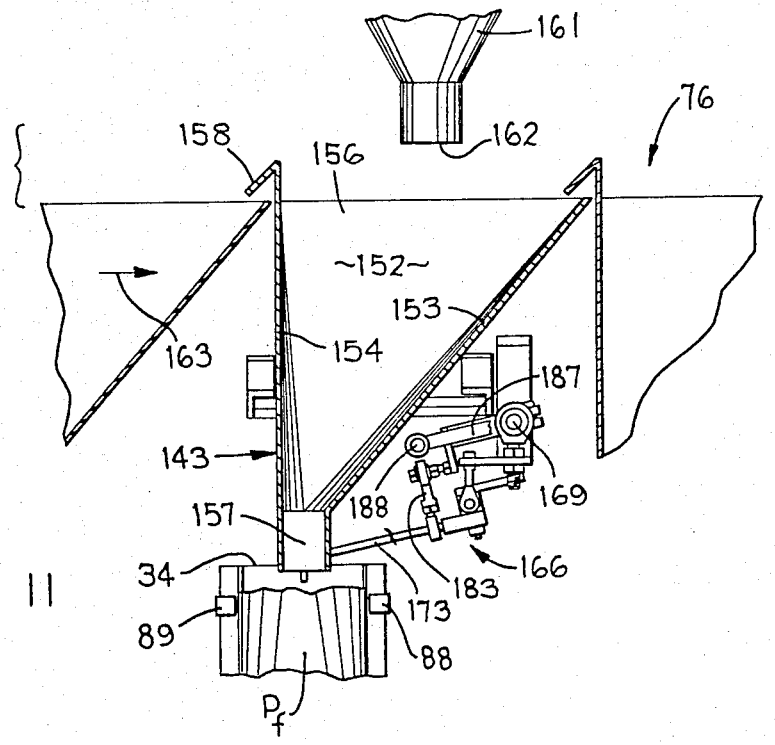
FIG. 11 is a fragmentary view, partially in cross section, taken along line XI—XI in FIG. 10.

Considering now the structure of the guide funnel 143, same comprises a substantially hollow truncated member which is of converging cross section as it extends from the upper inlet end to the lower outlet end thereof. The guide funnel 143 is defined by opposed sidewalls 152 which converge relative to one another as they project downwardly, these sidewalls being joined by a front or leading wall 153 and a rear or trailing wall 154. The front wall 153 extends rearwardly at a substantial angle as it projects downwardly, which angle may be in the neighborhood of at least 45° as measured relative to the horizontal, whereas the trailing wall 154 is approximately vertical. The funnel, in the illustrated embodiment, is of a substantially rectangular cross section when viewed in a horizontal plane, and has a substantially large rectangular inlet opening 156 at the upper end thereof, with the lower end of the funnel terminating in a small sleevelike discharge portion 157 which is positioned directly adjacent the trailing wall 154. As indicated in FIG. 11, the trailing wall 154 projects upwardly through a greater extent than the walls 152 and 153, and the upper end of this trailing wall 154 terminates in a deflector 158 which projects rearwardly and downwardly therefrom so that this deflector overlaps the upper edge of the leading wall of the adjacent trailing funnel while at the same time permitting a limited relative vertical movement between adjacent funnels.

In a preferred embodiment, the guide funnel 143 is provided with a replaceable nozzle portion on the lower end, the guide funnel thus being constructed of two funnel portions, namely an upper truncated funnel portion 143A which is connected to the parallelogram linkage, and the lower replaceable truncated funnel portion. These two portions are suitably bolted together by means of external annular collars which are fixedly associated therewith. The replaceable lower funnel portion permits a set of such nozzle portions to be provided, with the individual such portions having different sized or shaped discharge openings at the lower end thereof so as to provide the desired optimum filling of the selected package or pouch.

The material or product which is to be supplied to the pouches is fed to the funnels from a conventional hopper 161 which is stationarily positioned above the annular array of funnels, which hopper has a lower discharge opening or orifice 162 through which the material is discharged into the funnels which pass thereunder. To permit filling at a maximum rate, it may be necessary to utilize two or more such hoppers, 161, as indicated by dotted lines in FIG. 1, so as to permit the requisite quantity of material to be deposited into each funnel. The hoppers 161 are of conventional construction and are of the type which permits a substantially continuous but metered quantity of material to be discharged through the orifice 162. Since the guide funnels move at a continuous rotational rate beneath the opening 162, this thus determines the quantity of material deposited into each guide funnel. Further, since the annular array of guide funnels effectively defines a continuous series of openings 156, all of the material from the hopper 161 is effectively deposited into the funnels since the separation region between adjacent funnels employs the deflector 158 to insure that the material does not collect or deposit on the upper edge of the funnels. The funnels preferably have the configuration illustrated in FIG. 11 since, inasmuch as the funnels move beneath the opening 162 in the direction indicated by arrow 163, the provision of the sloped leading wall 153 coupled with the substantially vertical rear wall 154 thus greatly facilitates the efficient and rapid movement of the material downwardly through the funnel for discharge through the opening 157.

Figure 10:
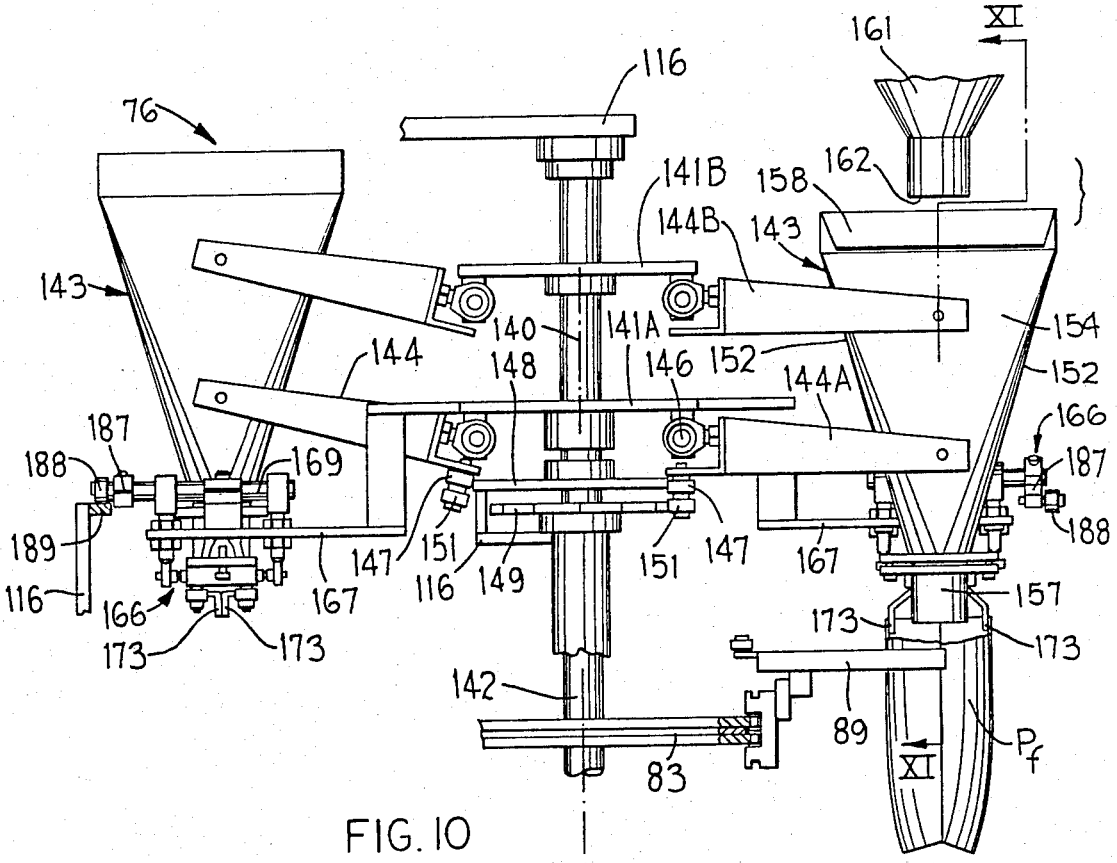
FIG. 10 is an enlarged, fragmentary sectional view taken substantially along line X—X in FIG. 1.

The individual funnels are, during each rotation of support plate 141, moved from the raised inactive position shown on the left side of FIG. 10, to the lowered filling position shown on the right side of FIG. 10, this movement being controlled by the peripheral profile of the stationary cam 148. The profile on this cam 148 maintains each funnel 143 in its raised position throughout approximately one-half (or slightly more) revolution of the support plate 141, such as throughout the angular extent indicated by arrow 164 in FIG. 1. However, throughout the remaining angular extent, which is normally a maximum of one-half revolution and typically somewhat less than this amount, such as indicated by the angular extent of arrow 165 in FIG. 1, the funnels 143 are individually lowered into the lowermost position illustrated by the right side of FIG. 1 which, due to the alignment and synchronization of the funnels and the pouches, permits the individual pouches to be filled with product or material. The filled pouches are designed $P_f$ for distinguishing same from the empty pouches $P_e$ as supplied to the filling station. The lowermost end of the discharge sleeve 157 associated with each filling funnel, when the filling funnel is in its lowermost position, is partially inserted into the open mouth of the pouch, as indicated by FIGS. 10 and 11, to thereby guarantee that the product or material is deposited into the pouch and is not spilled.

Since the lower end 157 of the guide funnel is inserted into the open pouch mouth during the filling operation, the filling assembly 76 also provides a pouch-centering device 166 disposed for cooperation with each of the funnels 143. This centering device 166 is mounted on a supporting plate or spoke 167 which is fixed to and projects outwardly from the support plate 141, which spoke 167 is positioned closely adjacent the leading side of the respective funnel. The spoke 167 stationarily mounts thereon a pair of aligned bearing blocks 168 (FIGS. 12 and 13) which rotatably support a first pivot shaft 169, the latter being disposed with its pivot axis extending substantially perpendicular to the rotational axis 140 (FIG. 10). A further pair of bearing blocks 171 are fixedly secured to and project downwardly from the support spoke 167, which bearing blocks rotatably support a second pivot shaft 172, the latter extending parallel to the first pivot shaft 169.

The latter-described pivot shafts are used for movably supporting a pair of identical L-shaped pouch-engaging fingers 173, which fingers each includes a substantially horizontally elongated rodlike portion which, at its free outer end, terminates in a short downwardly-directed engaging portion 173' adapted to be inserted into the pouch mouth. The fingers are individually supported due to the inner end of each being provided with a journal portion 173'' which is pivotally supported on a downwardly-projecting stub shaft 174, which stub shaft in turn is fixedly secured to a pivot block 176 that is fixedly supported on the pivot shaft 172. This pivot block 176 has a stop flange 177 which projects rearwardly therefrom and, adjacent its outer end, is provided with an adjustable stop screw 178 which is adapted to abut against the underside of the spoke 167 for limiting the pivoting (counterclockwise in FIG. 12) of the block 176.

A further pivot block 181 is fixedly supported on the other pivot shaft 169, which block projects radially outwardly from the pivot shaft and, at its outer end is provided with a pair of radially projecting stub shafts 182 disposed in adjacent side-by-side relationship. A connecting link is associated with each L-shaped finger 173, which connecting link is joined at its upper end to one of the stub shafts 182 by means of a swivel joint 184. A further swivel joint 186 joins the lower end of each connecting link 183 to its respective finger 173, this latter swivel joint 186 being positioned close to but spaced outwardly from the journal portion 173''.

Figure 14:
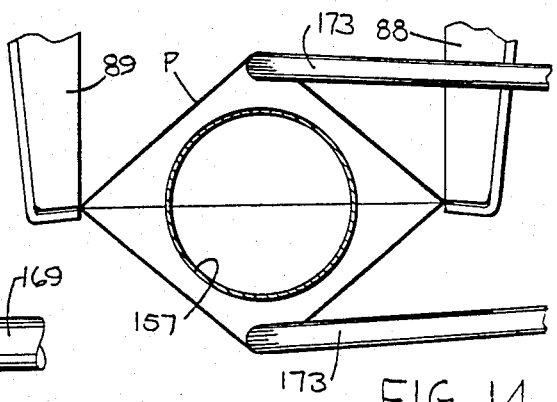
FIG. 14 is a top view which illustrates the positioning of the guide funnel and pouch opening mechanism within the open mouth of the pouch to permit filling of the pouch with the desired product.

As indicated by solid lines in FIGS. 12 and 13, the centering device 166 is normally maintained with the fingers 173 in the raised position wherein the fingers are positioned closely adjacent one another directly above the empty pouch $P_e$ but substantially directly below the discharge end of the respective funnel 143. However, just prior to insertion of the funeel into the pouch $P_e$, the centering device 166 is activated such that it is moved into its lowermost position as indicated by dotted lines in FIG. 12, in which position the fingers 173 have been lowered so that the portions 173' thereof are inserted into the bag mouth, and the fingers have been spread outwardly in opposite directions so that the portions 173' thus engage the opposite sides of the bag mouth to not only insure that the bag is fully opened, but also that the opened mouth is properly centered beneath the funnel so that the discharge portion thereof can be lowered into the pouch mouth. This relationship is illustrated by FIG. 14.

Figure 12:
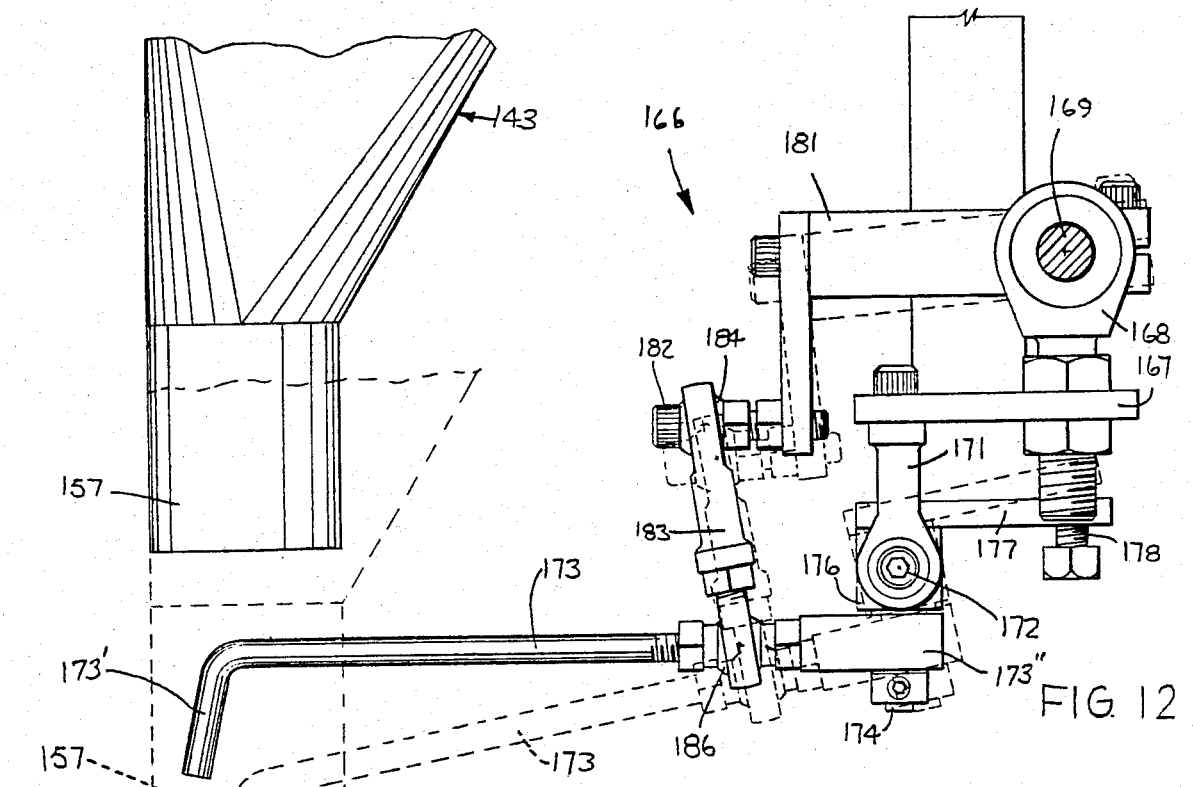
FIG. 12 is an enlarged, fragmentary, side elevational view illustrating the relationship between the funnel, the pouch and the pouch opening mechanism, this relationship being shown in a nonfilling condition by solid lines and in a filling condition by dotted lines.
Figure 13:
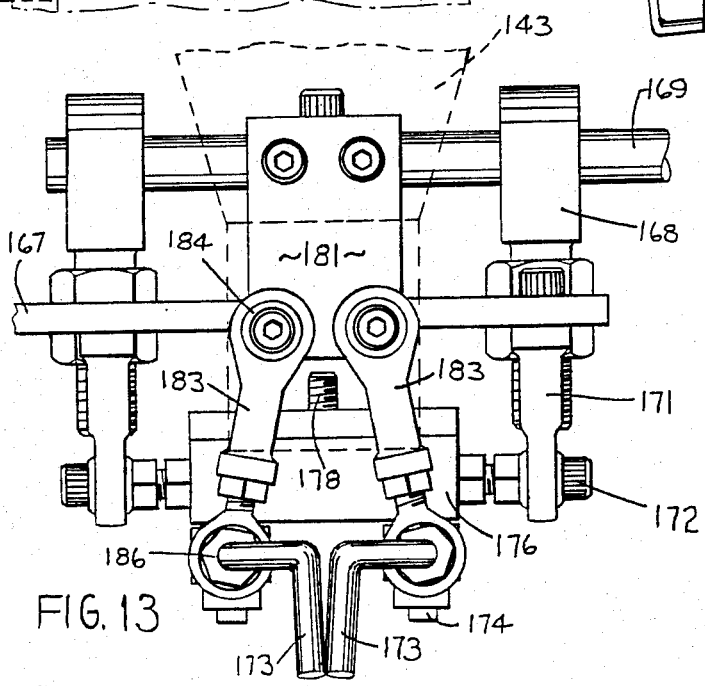
FIG. 13 is an elevational view taken from the left side of FIG. 12.

To activate the centering device 166 between its positions illustrated by solid and dotted lines in FIG. 12, each centering device has an actuator associated therewith which includes a lever arm 187 (FIG. 10) fixedly secured to and projecting radially of the pivot shaft 169. This lever arm, at its radially outer end, carries a cam roller 188 which is disposed for rolling engagement with a cam rail 189. The cam rail 189, which terminates the downwardly-directed ramps at the opposite free ends thereof, is stationarily fixed relative to the frame of the apparatus and is shaped substantially as a semicircle which is concentric with the axis 140. This cam rail 189 engages the individual cam rollers 188, and thus maintains the respective centering devices 166 in the raised position for approximately one-half revolution as the respective funnels extend through a major portion of the angular extent defined by the arrow 164. When the respective cam roller 188 reaches the downstream end of the cam rail 189, such as adjacent the end of the arcuate extent 164, the cam roller 188 drops off the cam rail 189 and thus permits the fingers 173 to be lowered into the empty pouch $P_e$ positioned thereunder. Shortly thereafter, the stationary cam 148 permits the respective funnel 143 to be lowered into the pouch. After passing through the angular extent 165, during which filling of the pouch occurs, then the reverse sequence occurs such that, when approaching the end of the arcuate extent 165, the stationary cam 148 initially cams the respective funnel 143 upwardly out of the pouch, following which the roller 188 engages the leading ramp on the cam rail 189 and causes the fingers 173 to be retracted upwardly out of the pouch, whereupon the filled pouch $P_f$ can then be moved from the filling station 74 into engagement with the vibrator 77.

During the lowering of the fingers 173 from the raised inactive position (shown in solid lines in FIGS. 12 and 13) into the pouch-engaging position, the lowering of the cam roller 188 causes a counterclockwise pivoting of the shaft 169 as indicated in FIG. 12. The pivot block 181 thus swings downwardly (counterclockwise in FIG. 12) causing a corresponding downward counterclockwise pivoting of arms 173 and pivot block 176. However, when the stop screw 178 abuts against the support spoke 167, this prevents further counterclockwise pivoting of block 176, whereupon further counterclockiwse pivoting of block 181, acting through the connecting links 183, thus causes the two fingers 173 to be swung or spread outwardly away from one another so that the portions 173' thereof thus engage the opposite sides of the pouch mouth and cause centering thereof relative to the funnel, substantially as indicated by FIG. 14.

After the filled pouch $P_f$ is moved out of the filling station 76, which pouch is still suspended from the mechanism 87, the bottom of the filled pouch is moved into contact with the vibrator 77. This vibrator, in the illustrated embodiment, comprises a relatively flat plate 191 which engages the lower end of the filled pouch, the plate being vibrated at a low amplitude and high frequency as the pouch is continuously slidably moved therealong due to the continuous movement of the chain 81. This thus effects settling of the product within the pouch, and also removes any powder or material which may have accidentally contacted the exterior of the pouch.

The continuously moving chain 81 then carries the pouch $P_f$ into the heating device 78 which includes a pair of opposed elongated electric heating bars 193 and 194 which extend in parallel relationship along the chain and are provided with a suitable gap therebetween in which is positioned the upper unsealed mouth of the pouch. These heating bars, in a conventional manner, heat the pouch material in the vicinity of the mouth thereof.

Simultaneous with the movement of the filled pouch through the heating device 78, the pouch support mechanism 87 engages suitable cam structure which effects a gradual spreading or opening of the arms 88–89 to thereby effect stretching and hence closing of the pouch mouth. This is accomplished by an elongated cam rail 192 (FIG. 1) which extends approximately parallel with the side reach of the chain 81 and extends longitudinally from a position adjacent the inlet end of the heating device 78 until reaching the discharge station as located adjacent the conveyor 198. This cam rail 192 has the inner camming surface thereof positioned at an extremely small converging angle relative to the direction of movement of the chain such that, when the cam rollers of the individual arms 88–89 engage the inner surface of the cam rail 192, the opposed pair of arms 88–89 are gradually swung away from one another into an intermediate position wherein the mouth of the pouch is stretched taut, thereby holding the mouth closed (but unsealed), while at the same time the arms 88–89 still securely hold and suspend the filled pouch $P_f$.

After leaving the heating device 78, the mechanism 87 then moves the filled pouch $P_f$ into and through the sealing device 79. This sealing device 79 is of convention 1 construction and, as is typical, employs a pair of counter-rotating sealing rollers which engage the opposite sides of the filled pouch in the vicinity of the upper edge thereof to thereby pressingly heat seal the upper edge or mouth of the pouch. These heat seal rollers are continuously rotatably driven by means of the chain or endless belt 133, as indicated in FIG. 1. Since the pouch mouth has been stretched taut prior to entering the sealing device 79, an effective seal of the mouth can be achieved in a reliable and dependable manner without any significant wrinkling or puckering of the sealed mouth.

After leaving the sealing device 79, the sealed and filled pouch (designated $P_s$) is then carried by the mechanism 87 to a suitable discharge station, such as adjacent and directly over the conveyor 198 utilized for removing the filled pouches from the apparatus. When reaching this discharge station, the cam rollers 107 and 107' as associated with the pair of arms 88–89 simultaneously engage a pair of vertically and longitudinally spaced cam rails 196, whereby the jaws 101 associated with the pair of arms 88–89 are simultaneously opened, thereby dropping the pouch $P_s$ onto the conveyor 198.

After dropping the pouch $P_s$, the arms 88–89 continue to move forwardly whereby their cam rollers move out of engagement with the cams 192 and 196, whereupon the arms 88–89 associated with each mechanism 87 thus return to their innermost position and are again conveyed around and into the inlet station 72 for receiving and supporting a further preformed empty pouch $P_e$ in the same manner as described above.

Since the overall operation of system 10 has been described above relative to the individual components and apparatus thereof, further detailed description of the overall operation is thus believed unnecessary.

The system of this invention, as described above, has so far proven to be capable of handling and filling individual and separate preformed bottom-gusset nonself-supporting pouches at a relatively high rate, such as in the order of 150 pouches per minute, and it is expected that this system will be capable of filling pouches at the rate of approximately 200 per minute. These relatively high rates of production were previously obtainable only when utilizing the previously-described "continuous" machines, but such machines are not able to handle individual pouches of this type. The present invention thus retains the flexibility and adaptability of prior "intermittent" machines in that it is capable of handling said pouches but does so in a continuous manner, whereby the production rate is thus substantially greater than the rate achieveable with most "intermittent" machines.

The present invention is thus able to fill pouches at a relatively high rate, and at the same time does so with high efficiency in that it does not permit loss of any significant quantity of material (such as powder) during filling of the pouches. This is particularly significant since, if any loss of material occurs during filling, then this can result in the pouches being underweight, and this in turn is compensated for by overfilling the pouches, thereby resulting in wastage of material. The present invention thus permits the pouches to be accurately filled with the desired quantity, while at the same time permitting minimization in the required overfilling.

The present invention further increases the efficiency and reliability of the top seal by supporting the filled pouch in such a manner as to easily maintain the mouth in a taut condition throughout the sealing operation, thereby eliminating both sagging and puckering of the pouch material, and insuring a proper seal.

Still further, this invention permits the individual preformed pouches to be properly centered so as to receive the filling funnel during the filling operation, thereby positively avoiding spilling of the material or product. This avoids wastage of material, prevents underfilling of pouches, and eliminates or minimizes the required machine cleanup. This system also permits the pouches to be preformed in an intermittent manner, with the pouches then being efficiently and effectively transferred for continuous handling during the filling stage, with both the intermittent and continuous handling of the pouches, and the intermediate transfer thereof, occurring at a relatively high rate. The system also possesses maximum flexibility and adjustability to accommodate pouches of different size and/or shape and/or material, and additionally permits the pouches to be filled with numerous types of materials and products and/or different quantities of such products. Further, the change-over of the system for handling, forming and filling different pouches can be carried out with a minimum of machine down time.

Figure 15:
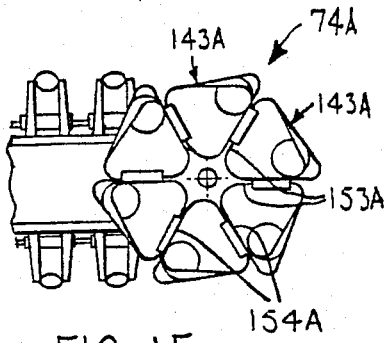
FIG. 15 is a fragmentary top view similar to FIG. 1 but illustrating a modified filling assembly.

FIG. 15 is a fragmentary top view similar to FIG. 1 but showing a modified filling assembly 74A which is structurally and functionally identical to assembly 74 except for the shape of the individual guide funnels 143A. In this preferred embodiment, the funnel 143A is approximately of triangular cross section, being provided with rounded corners. The leading wall 153A extends approximately radially from the rotation axis, and slopes downwardly toward the trailing wall 154A. This latter wall is substantially vertical and extends approximately radially from the rotational axis. The funnel 143A otherwise corresponds to funnel 143.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for filling a pouch having an openable mouth, comprising:

a frame;

a pouch-supporting mechanism for supporting a preformed pouch so that the mouth thereof opens upwardly;

filling means positioned above said pouch for permitting selected material to be deposited into said pouch through the open mouth thereof, said filling means including a filling member having a lower portion which is positionable adjacent the mouth of said pouch and defines a downwardly directed discharge opening for permitting discharge of said material into said pouch; and a centering mechanism for engaging the mouth of said pouch and holding same in an opened and centered relationship relative to the discharge opening of said filling member, said centering mechanism including a pair of horizontally elongated pouch-engaging elements which are pivotally mounted adjacent one end thereof and are free adjacent the other end thereof, the free ends of said elements defining downwardly projecting portions which are adapted to project into the pouch mouth for engagement with the opposite sidewalls of the pouch, said pouch-engaging elements being normally maintained in a raised position wherein said free ends are disposed directly adjacent one another and are positioned vertically between said discharge opening and the mouth of said pouch, said pouch-engaging elements being moved into a lowered centering position wherein the free ends of said elements project into the open mouth of said pouch and are horizontally spaced a substantial distance from one another for engaging the opposite sidewalls of the pouch in the vicinity of the mouth thereof, said pouch-engaging elements during movement from said raised to said lowered centering position being moved through an intermediate lowered position wherein said free ends of said elements project into the open mouth of said pouch but are still maintained closely adjacent one another;

said centering mechanism including swivel means mounting said one ends of said pouch-engaging elements for permitting both vertical swinging of said elements between said raised and intermediate lowered positions and horizontal swinging of said elements between said intermediate lowered position and said lowered centering position, and stop means for limiting the downward vertical swinging of said elements when they reach said intermediate lowered position; and said centering mechanism including activating linkage means interconnected to said pouch-engaging elements for effecting movement thereof from said raised position into said intermediate lowered position and thence into said lowered centering position, said activating linkage means including a pivot member swingable about a substantially horizontal pivot axis, a pair of activating links pivotally connected at one ends thereof to said pivot member and respectively individually pivotally connected at the other ends thereof to said pouch-engaging elements at locations spaced intermediate the ends thereof, and actuating means interconnected to said pivot member for effecting swinging movement thereof from a first end location through an intermediate location into a second end location, whereby swinging movement of said pivot member from said first end location to said intermediate location acts through said activating links for swinging said pouch-engaging elements downwardly from said raised position into said intermediate lowered position until limited by said stop means, whereupon further swinging of said pivot member from said intermediate location toward said second end location acts on said activating links to cause said pouch-engaging elements to be swung outwardly away from one another into said lowered centering position wherein the free ends of said elements engage the opposite sidewalls of the pouch to hold the mouth open in centered relationship to the discharge opening of the filling member.

2. An apparatus according to claim 1, wherein said pivot member is positioned above said pouch-engaging elements, and wherein said activating links are pivotally connected to said pivot member and project downwardly for pivotal connection to said pouch-engaging elements in the vicinity of said one ends thereof.

3. An apparatus according to claim 2, wherein said swivel means includes a second pivot member which is positioned vertically below said first-mentioned pivot member and is disposed for vertical pivoting movement about a second substantially horizontal pivot axis which is substantially parallel to said first-mentioned pivot axis, said one ends of said pouch-engaging elements being pivotally supported on said second pivot means for substantially horizontal swinging movement about axes which extend substantially perpendicular with respect to said second pivot axis, and said stop means cooperating with said second pivot member for limiting the downward pivoting thereof when said pouch-engaging elements are lowered into said intermediate lowered position.

4. An apparatus according to claim 1, including means for lowering said filling member so that the lower portion thereof projects into the open mouth of said pouch between said pouch-engaging elements when the latter are in said lowered centering position.

* * * * *